United States Patent [19]

Kato et al.

[11] 4,127,841

[45] Nov. 28, 1978

[54] MULTI-DIRECTION CONTROLLING MECHANISM

[75] Inventors: Yasuo Kato, Yokohama; Motoo Kakiuchi, Tokyo; Takashi Arai, Mishima; Kunio Okawa, Shizuoka, all of Japan

[73] Assignee: Toshiba Kikai Kabushiki Kaisha, Tokyo, Japan

[21] Appl. No.: 819,817

[22] Filed: Jul. 28, 1977

[30] Foreign Application Priority Data

Jul. 30, 1976 [JP] Japan ..... 51-90990

[51] Int. Cl.[2] ..... H01C 10/16

[52] U.S. Cl. ..... 338/128; 74/471 XY

[58] Field of Search ..... 338/128, 129, 135; 74/471 XY; 244/83 J, 83 G, 83 F, 83 E

[56] References Cited

U,S. PATENT DOCUMENTS

| | | | |
|---|---|---|---|
| 3,365,975 | 1/1968 | Hathaway | 338/128 X |
| 3,372,359 | 3/1968 | Wilson | 338/128 |
| 3,739,316 | 6/1973 | Tokubo | 338/128 |
| 3,745,966 | 7/1973 | Seager | 338/128 |
| 3,781,752 | 12/1973 | Oka et al. | 338/128 |
| 3,870,161 | 3/1975 | Cording | 74/471 XY X |
| 3,870,986 | 3/1975 | Oka et al. | 338/128 |
| 3,918,021 | 11/1975 | Nishioka et al. | 338/128 |
| 3,939,451 | 2/1976 | Kasahima | 338/128 |

*Primary Examiner*—C. L. Albritton

*Attorney, Agent, or Firm*—Koda and Androlia

[57] ABSTRACT

The controlling lever of the mechanism for use in civil work machines or cargo winches is supported by a spherical bearing so as to be tiltable in any direction by any inclination angle. Four horizontal shafts are provided to extend in the +X, −X, +Y and −Y directions of a rectangular coordinate about the center of rotation of the controlling lever. Four arms are rotatably mounted on respective shafts and are biased by torsion springs wound about respective shafts. Slidable contacts are mounted on respective arms to slide along rheostats, thus producing electric signals proportional to the direction and angle of inclination of the controlling lever.

5 Claims, 7 Drawing Figures

MULTI-DIRECTION CONTROLLING MECHANISM

BACKGROUND OF THE INVENTION

This invention relates to a multi-direction controlling mechanism, and more particularly a multi-direction controlling mechanism for generating electric signals utilized to drive various actuators in accordance with the operation of a controlling lever.

The operator of an oil pressure actuated machine utilized to move heavy bodies, such as civil work machines or winches of cargo ships, manipulates the controlling lever of the machine so as to convey the heavy bodies or loads along a path and at a speed which are most suitable for the operation while watching the speed and position of the loads.

Although various types of multi-direction controlling mechanism have been used, they are constructed in a manner to ON-OFF control a switch or to provide a proportional control in only one axial direction and not constructed to provide simultaneous proportional control in two or three axial directions with compact construction. Furthermore, it has been impossible to operate the controlling lever over a wide stroke range and hence to vary the proportional control output signal over a wide range so that it is impossible to finely control the heavy load.

SUMMARY OF THE INVENTION

It is an object of this invention to provide an improved multi-direction controlling mechanism adapted for use in civil work machines or cargo winches wherein the controlling lever is tilable in any direction at any desired angle of inclination so as to produce an electric signal corresponding to the direction and angle of inclination of the controlling lever.

Another object of this invention is to provide an improved multi-direction controlling mechanism constructed such that the controlling lever is normally maintained at the neutral position, that it can be inclined in any desired direction by applying a definite force and that the controlling lever can automatically return to the neutral position when it is realeased thus decreasing the electric signal to zero.

Still another object of this invention is to provide a novel multi-direction controlling mechanism constructed to produce four electric signals proportional to the direction and angle of inclination of the controlling lever, the magnetudes of the signals being proportional to the projections of the controlling lever on two planes intersecting at right angles.

According to this invention, these and further objects can be accomplished by providing a multi-direction controlling mechanism comprising a controlling lever supported by a spherical bearing at an intermediate point to be tiltable in any direction and provided with a lateral slot and a shaft portion on one side of the spherical bearing, a first pair of shafts supported by a stationary casing of the mechanism to coaxially extend along a line passing through the center of rotation of the controlling lever, a pair of link members rotatably mounted on the first pair of shafts respectively, a second shaft extending through the slot in parallel with the first pair of shafts, a first pair of arms rotatably mounted on the first pair of shafts respectively, a first pair of torsion springs respectively wound about the first pair of shafts for urging the first pair of arms for urging the same against the second shaft, a second pair of shafts supported by the casing and extending in a direction normal to the first pair of shafts, a third pair of shafts extending from the opposite sides of a guide member in parallel with the second pair of shafts, the guide number being provided with a slot for receiving the shaft portion of the controlling lever, a second pair of arms rotatably mounted on the second pair of shafts, a second pair of torsion springs respectively wound about the second pair of shafts for urging the second pair of arms against the third pair of shafts respectively in the opposite direction, and a plurality of electric signal generating means operated by one ends of the first and second pairs of arms for generating electric signals in response to the rotation of the arms, whereby when the controlling lever is tilted in any direction by any inclination angle, the signal producing means produce electric signals corresponding to the direction and angle of inclination of the controlling lever.

DESCRIPTION OF THE PREFERRED EMBODIMENT

Figure 1:
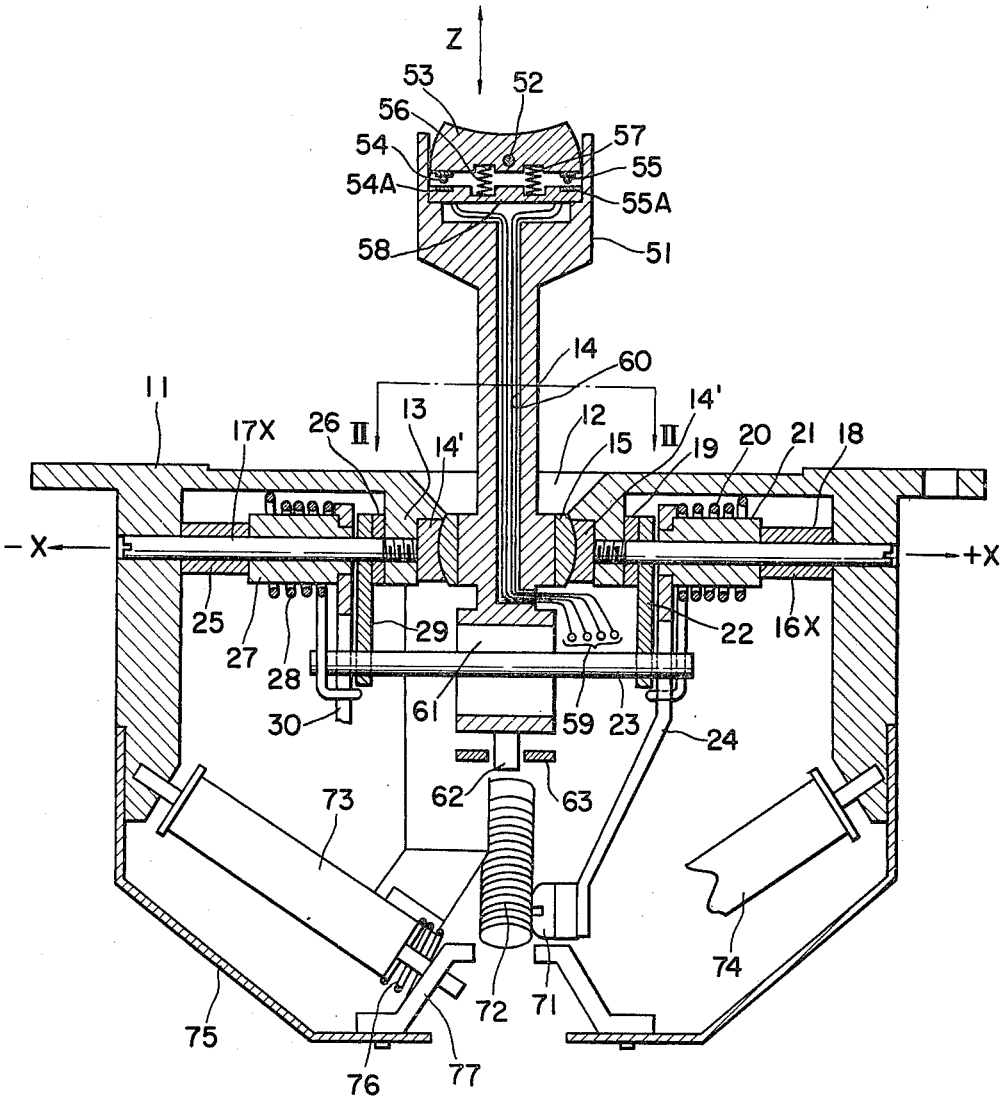
FIG. 1 is a longitudinal sectional view showing one embodiment of this invention.
Figure 2:
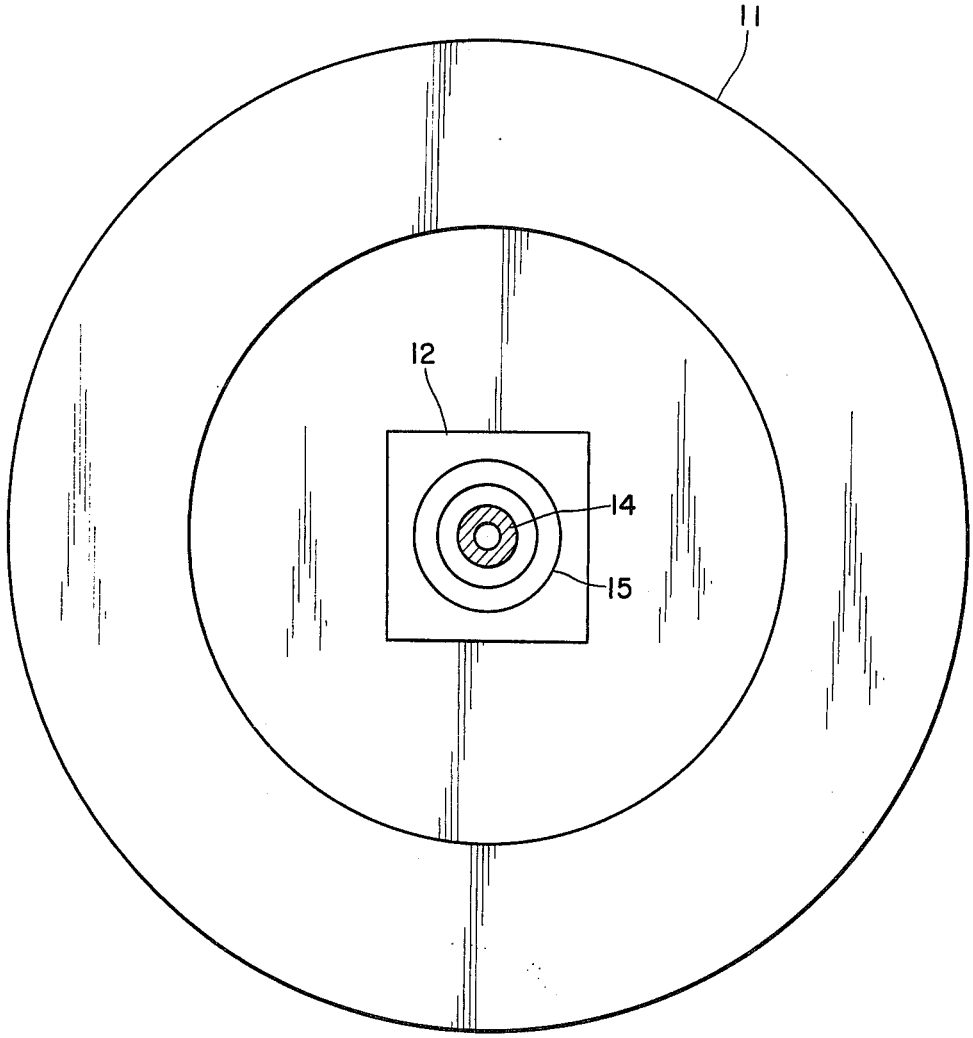
FIG. 2 is a sectional view taken along a line II—II in FIG. 1.

A preferred embodiment of this invention shown in FIG. 1 comprises a casing 11 having a upper plate provided at its center with a perforation 12 whose upper end is squared as shown in FIG. 2. In the opening of the central boss 13 of the casing 11 is fitted a spherical seat 14' for supporting a spherical bearing 15 fitted on the central portion of a controlling lever 14 extending through the perforation. The square perforation 12 permits maximum inclination of the controlling lever 14 in the diagonal direction of the square rather than a circular perporation inscribing the square. If a circular opening having a radius equal to one half of the diagonal to obtain the same maximum inclination it would be necessary to provide suitable stops when the lever 14 is inclined in directions other than the diagonals. It is assumed that the vertical direction of the drawing coincides with the Z axis, the horizontal direction with the +X and −X axes, and the direction perpendicular to the sheet of drawing with the +Y and −Y axes of the three dimensional rectangular coordinates.

Horizontal shafts 16X and 17X are provided to extend between the boss 13 and the side walls of the casing 11 with the inner ends of the shafts 16X and 17X threaded into the boss. Shafts 16X and 17X extends through the center of rotation of the controlling lever 14. A cylindrical member 21 surrounded by a torsion spring 20 and a rotatable link plate 22 are mounted on shaft 16X between spacers 18 and 19, and the lower end of the link plate 22 supports the righthand end of a horizontal shaft 23. An arm 24 is rotatably mounted on the lefthand end of the cylindrical member 21. The arm 24 is positioned behind the shaft 23 and connected to one end of the torsion spring 20 so as to urge the shaft 23 in a direction toward the front side of the drawing.

In the same manner, spacers 25 and 26, a cylindrical member 27 wound with a torsion spring 28, a link plate 29 and an arm 30 are mounted on shaft 17X. These members are arranged in the same manner as the corresponding members on shaft 16X except that since arm 30 is positioned in front of shaft 23, the arm 30 is urged by the torsion spring 28 in the direction toward the shaft 23.

Although not shown in FIG. 1, two sets of members corresponding to shaft 16X, link plate 22, arm 24 and torsion spring 20 are disposed on the front and rear sides of the controlling lever 14. A switch is mounted on the head 51 of the controlling lever 14 for producing a command signal for raising and lowering the load. More particularly, a switch actuating member 53 is rotatably supported by a horizontal pin 52 provided for the head 51, and two switch contacts 54 and 55 are secured to the bottom of the switch actuating member 53 which is urged upwardly by springs 56 and 57 received in slots of a supporting member 58 which is contained in the head. Contacts 54A and 55A are mounted on the supporting member 58 to cooperate with contacts 54 and 55, respectively. Thus, by depressing the actuating member 53, either one of the contact pairs 54–54A and 55–55A is closed, one pair being used to raise the load and the other to lower the load. Lead wires 59 connected to respective contacts extend through the central bore 60 of the controlling lever 14 and are derived out at the lower end thereof.

The controlling lever 14 is provided with a transverse slot 61 having a width slightly larger than the diameter of shaft 23 beneath the spherical bearing 15 so as to hold the shaft 23. The diameter of the portion of the lever 14 beneath the slot 61 is reduced as at 62 which is guided in the Y direction by a slot 80 of a guide member 63. (See FIG. 3)

Figure 3:
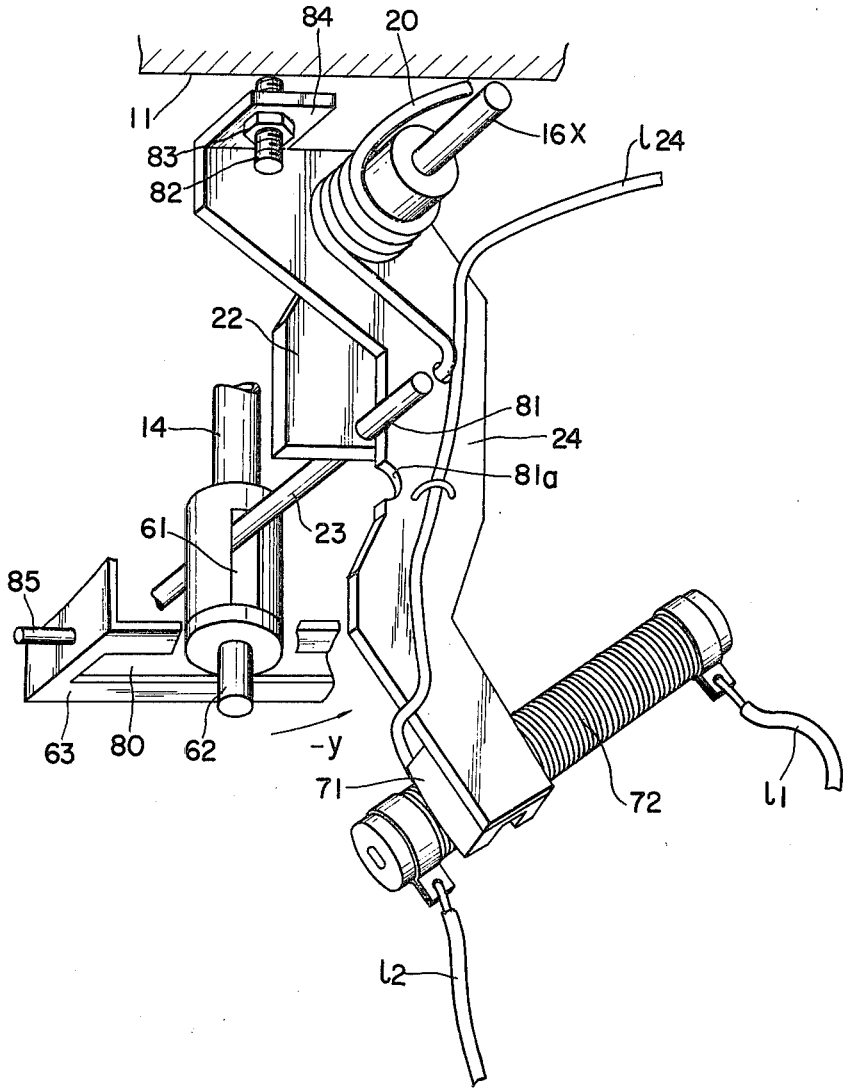
FIG. 3 is a perspective view useful to explain the rotation of an arm.

Sliding contacts 71 are mounted on the lower ends of arms 24 and 30 which rotate about shafts 16X, 17X, 16Y and 17Y (the latter two are not shown) and each contact 71 is caused to slide along a rheostat 72, as shown in FIGS. 1 and 3. Although not fully shown, a contact and rheostats 73 and 74 identical to contact 71 and rheostat 72 are also provided for other arms. Each one of the rheostats 72, 73 and 74 is held by a clamping member 77 with one end secured to the bottom cover 75 of casing 11 and the other end resiliently holding the theostat through a spring 76 as shown in FIG. 1.

FIG. 3 is a perspective view showing the manner of rotating arm 24 by shaft 23 when the head 51 of the controlling lever 14 is pulled toward the front side of the drawing (that is in the direction of +Y). Under this condition the slot 61 of the controlling lever 14 is rotated about the spherical bearing in the direction of −Y with the result that the reduced diameter portion 62 is also rotated in the direction of −Y by being guided by guide groove 80. Consequently, shaft 23 loosely received in slot 61 is also rotated in the same direction to be received in a semicircular recess 81 of the arm 24 thereby rotating arm 24 in the same direction about shaft 16X against the force of the torsion spring 20 as shown in FIG. 3. Accordingly, the sliding contact 71 mounted on the lower end of the arm 24 is moved along the rheostat 72 to vary its resistance. As the opposite ends of the rheostat 72 are connected to lead wires $l_1$ and $l_2$ the signal current flowing through these lead wires is varied. In order to limit the rotation of the arm 24 in the direction of +Y, a stop screw 82 is fastend by a nut 83 to a bent portion 84 of the arm to engage the inner surface of the casing 11. By adjusting nut 83, the position of the arm 24 can be adjusted. The arm 24 is formed with another semicircular recess 81*a* just beneath the semicircular recess 81. The purpose of the recess 81*a* is to receive a shaft (which corresponds to shaft 23 shown in FIG. 1 and designated by reference numerals 85 and 86 in FIG. 4). It should be understood that there are four arms corresponding to arm 24, each provided with two semicircular recesses 81 and 81*a*, and arranged in the +X, −X, +Y, −Y directions of the rectangular coordinate.

Figure 4:
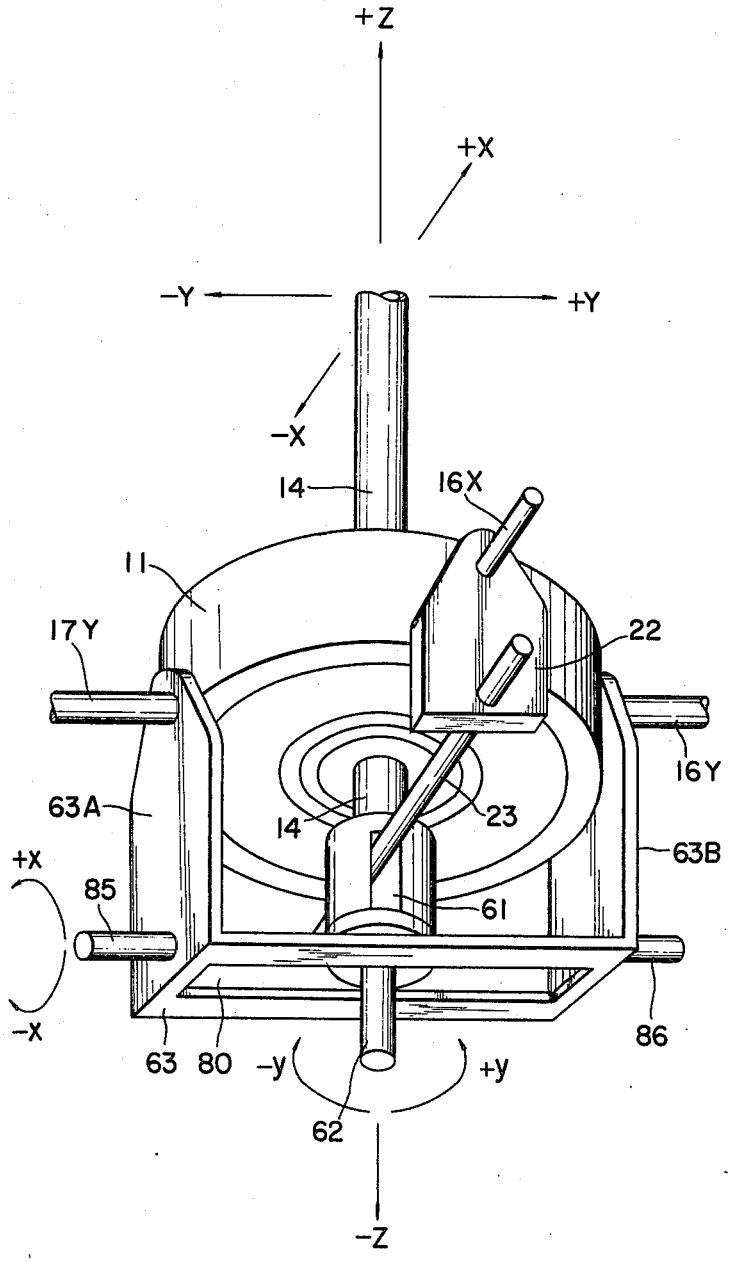
FIG. 4 is a perspective view useful to explain a link mechanism and a guide member of the mechanism.

FIG. 4 is a perspective view showing the operation of the link mechanism when the controlling lever 14 is rotated or tilted.

When the upper end of the controlling lever 14 is tilted in the +Y direction, owing to the presence of the spherical bearing, slot 61, and shaft 62 which is guided by slot 80 are rotated in the −Y direction whereby shaft 23 is rotated about shaft 16X in the −Y direction so that the end of shaft 23 protruding beyond plate 22 rotates arm 24 in the same direction. In the same manner, when the controlling lever 14 is tilted in the −Y direction, shaft 23 will be rotated in the +Y direction thus rotating link plate 29, and arm 30 (see FIG. 1) in the +Y direction about shaft 17X. When the upper end of the controlling lever 14 is tilted in +X direction, guide 63 will be rotated in the −X direction above shafts 16Y and 17Y whereas when the controlling lever is tilted in the −X direction, the guide 63 will be rotated in the +X direction. To the lower ends of the side plates 63A and 63B are secured outwardly extending shafts 85 and 86 respectively which are received in the semicircular recesses 81*a* of the arms (not shown, but corresponding to arm 24 shown in FIG. 24 and disposed near the opposite ends of the guide 63 in a direction perpendicular to arm 24) so that when the guide 63 is rotated in the +Y direction the arm 87 (FIG. 5) coupled with shaft 85 is rotated in the +X direction, whereas when the guide 63 is rotated in the −X direction, the arm 88 (see FIG. 5A) coupled with shaft 86 will be rotated in the −X direction.

With the link mechanism described above when the upper end of the controlling lever is tilted in the ±Y directions guide 63 would not be rotated in the ±X directions whereas when the controlling lever is tilted in the ±X directions, the rotation of the shaft 23 in the ± directions would be prevented by slot 63.

Figure 5A:
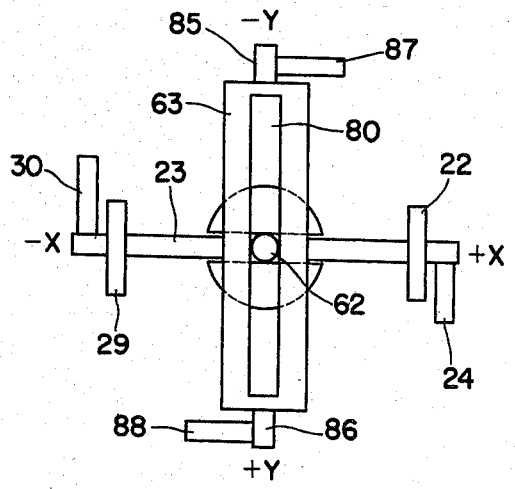
FIGS. 5A, 5B and 5C are diagrams to show the rotation of the arms corresponding to the inclination of the controlling lever.
Figure 5B:
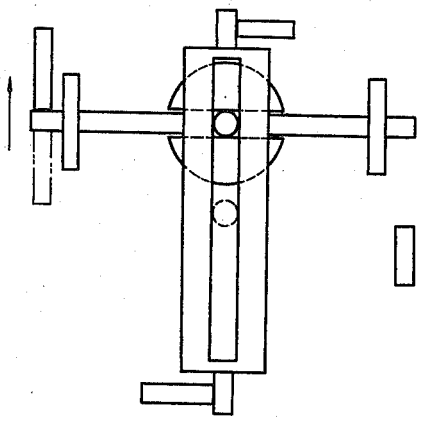
Figure 5C:
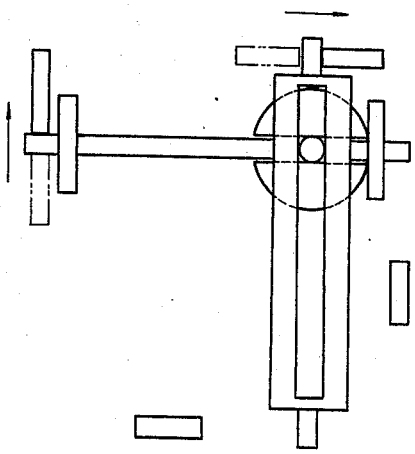

FIGS. 5A, 5B and 5C are diagrammatic representations of a plan view of FIG. 4 in which FIG. 5A shows a condition in which the controlling lever 14 is at the neutral position or in the direction of Z axis. In this case, arms 24, 30, 87 and 88 are held in zero positions respectively.

FIG. 5B shows a condition in which the shaft 62 has been moved in the −Y direction to the maximum extent (lever 14 is moved in the +Y direction). Under these conditions arm 30 is moved in the −Y direction but arm 24 is held in the condition shown in FIG. 5A by stop 82 and arms 87 and 88 are held in the condition shown in FIG. 5A since the positiones of shafts 85 and 86 do not vary.

FIG. 5C shows a condition in which shaft 62 has been moved to the maximum extent in the −Y and +X directions. In this case, arms 30 and 87 are rotated to the maximum extent in the X and Y directions respectively so that the rheostats cooperating with these arms produce maximum outputs whereas the rheostats cooperating with arms 24 and 88 zero outputs as in the condition shown in FIG. 5A.

Various portions of the embodiment described above can be modified as follows.

More particularly, in the construction shown in FIG. 1, the control signal for the Z direction is merely ON-OFF controll by switch actuating member 53 but it is easy to vary the output in proportion to the degree of inclination of the switch actuating member 53 as in the case when the controlling lever is tilted in the Y or X axis direction. This can readily be accomplished by using a differential transformer or a magnetic reluctance element actuated by the member 53.

The rheostat comprising a wound resistor and a sliding contact shown in FIGS. 1 and 3 is liable to become faulty due to the breakage of the resistance wire but with a differential transformer, magnetic relactance element or a non-contact type variable resistor or impedetance it is possible to obviate this difficulty.

This invention has the following advantages.

1. Since a spring is provided for returning the controlling lever to the neutral position, when released, the controlling lever returns to the neutral position thus reducing the output signal to zero.

2. Since the controlling lever does not rotate about its axis, it is not necessary to use slip rings or the like for the lead wires extending in the direction of Z axis.

3. Since the casing is provided with a square perforation the maximum output of the mechanism when the controlling lever is inclined in the X or Y direction to the maximum extent is equal to the maximum output when the controlling lever is inclined to the direction of a resultant of the X and Y directions, that is 45°.

4. Where the controlling lever is inclined in any direction by any angle it is possible to produce an electrical signal corresponding to the direction and angle of inclination.

5. As the rheostats are disposed at an angle with respect to the vertical it is possible to make compact the construction of the entire mechanism.

We claim:

1. A multi-direction controlling mechanism comprising a controlling lever supported by a spherical bearing at an intermediate point to be tiltable in any direction and provided with a lateral slot and a shaft portion on one side of said spherical bearing, a first pair of shafts supported by a stationary casing of the mechanism to coaxially extend along a line passing through the center of rotation of said controlling lever, a pair of link members rotatably mounted on said first pair of shafts respectively, a second shaft extending through said slot in parallel with said first pair of shafts, a first pair of arms rotatably mounted on said first pair of shafts respectively, a first pair of torsion springs respectively wound about said first pair of shafts for urging said first pair of arms against said second shaft, a second pair of shafts supported by said casing and extending in a direction normal to said first pair of shafts, a third pair of shafts extending from the opposite sides of a guide member in parallel with said second pair of shafts, said guide member being provided with a slot for receiving said shaft portion of said controlling lever, a second pair of arms rotatably mounted on said second pair of shafts, a second pair of torsion springs respectively wound about said second pair of shafts for urging said second pair of arms against said third pair of shafts respectively in the opposite direction, and a plurality of electric signal generating means operated by one ends of said first and second pairs of arms for generating electrical signals in response to the rotation of said arms, whereby when said controlling lever is tilted in any direction by any inclination angle, said signal producing means produce electric signals corresponding to the direction and angle of inclination of said controlling lever.

2. The multi-direction controlling mechanism according to claim 1 which further comprises a switch mounted on the top of said controlling member, said switch comprising a switch actuating member pivotally supported by a pin extending in the direction perpendicular to the longitudinal axis of said controlling lever, and contacts selectively controlled by said switch actuating member for determining the direction of movement of a load controlled by said controlling lever.

3. The multi-direction controlling mechanism according to claim 1 wherein said casing is provided with a square shaped opening on the side of said spherical bearing opposite said slot and said shaft portion.

4. The multi-direction controlling mechanism according to claim 1 wherein each of said electric signal generating means comprises a rheostats disposed at an angle with respect to the vertical and a sliding contact mounted on one end of one of said first and second pairs of arms for sliding along said rheostat.

5. The multi-direction controlling mechanism according to claim 1 wherein each one of said arms is provided with adjustable stop means which cooperate with the inner wall of said casing.

* * * * *